US007351126B2

(12) United States Patent
Turner

(10) Patent No.: US 7,351,126 B2
(45) **Date of Patent: *Apr. 1, 2008**

(54) COMBINATION WETSUIT AND FLOTATION DEVICE, AND METHOD OF USE

(76) Inventor: Franklin A. Turner, 2381 Mosaybank Dr., #7, Sacramento, CA (US) 95833

( * ) Notice: Subject to any disclaimer, the term of this patent is extended or adjusted under 35 U.S.C. 154(b) by 0 days.

This patent is subject to a terminal disclaimer.

(21) Appl. No.: 11/283,373

(22) Filed: Nov. 21, 2005

(65) Prior Publication Data

US 2006/0073749 A1 Apr. 6, 2006

Related U.S. Application Data

(63) Continuation-in-part of application No. 10/948,647, filed on Sep. 24, 2004, now Pat. No. 6,976,894.

(51) Int. Cl.
*B63C 9/08* (2006.01)
*B63C 9/15* (2006.01)

(52) U.S. Cl. ..... 441/103; 441/92

(58) Field of Classification Search ..... 441/103, 441/106, 108, 111–119
See application file for complete search history.

(56) References Cited

U.S. PATENT DOCUMENTS 576,649 A 2/1897 Bell
2,306,488 A 12/1942 Morner
D199,514 S 11/1964 O'Neill
4,242,769 A 1/1981 Rayfield et al.
4,397,636 A 8/1983 Ganshaw
4,673,366 A 6/1987 Hawkins
4,704,092 A 11/1987 Liukko
5,022,878 A 6/1991 Casad
D359,097 S 6/1995 Crandall
5,759,076 A 6/1998 Bateman
6,666,622 B1 12/2003 Courtney et al.

*Primary Examiner*—Jesús D Sotelo
(74) *Attorney, Agent, or Firm*—Eric Hanscom; Todd Langford; Ryan Friedl

(57) ABSTRACT

The invention is directed to a wetsuit/floatation device which advantageously provides a combination wetsuit/flotation device integral with the wet suit so that a user can maintain unrestricted movement during water-sport activities and have the option of gaining instant buoyancy during times of dangerous water conditions. The invention can be made in a number of embodiments, with one being a vest which can be worn over a person's skin or over another wetsuit. The vest has an inflatable bladder extending from two chest panels around the back of the user's neck, with a valve connected to a removable CO2 canister which is triggered by a pull cord/handle extending outside of the wetsuit. The vest also has an inflation adjustment valve located near the neck by which a user can orally inflate or adjustably deflate the vest.

9 Claims, 7 Drawing Sheets

COMBINATION WETSUIT AND FLOTATION DEVICE, AND METHOD OF USE

CROSS REFERENCE TO RELATED APPLICATIONS

This application is a continuation-in-part from application Ser. No. 10/948,647 filed Sep. 24, 2004, which was issued on Dec. 20, 2005 as U.S. Pat. No. 6,976,894 B1, the contents of which are incorporated by reference into this application.

STATEMENT REGARDING FEDERALLY SPONSORED RESEARCH OR DEVELOPMENT

This invention was not federally sponsored.

BACKGROUND OF THE INVENTION

1. Technical Field

This invention relates to a wet suit and, more particularly, to a combination wet suit and flotation device including an actuator for inflating a bladder integral with the wetsuit so that a user's head can be maintained above a water line during emergency conditions.

2. Prior Art

There are many different types of personal flotation devices currently in use by water sport enthusiasts. In particular, a personal flotation device such as a Coast Guard Type III life vest is popular- These life vests are designed for use in calm inland waters where there is a good chance of fast rescue. These vests, however, are not suitable to be worn by individuals that are performing activities such as diving or surfing which requires constant and free range of movement, and thus leaves them in a dangerous situation when staying above water becomes a problem. As such, the performance along with the comfort and wearability of the personal flotation device is important.

In addition, the wearability of the personal flotation device is affected by the buoyancy of the personal flotation device. Typically, the buoyant material of the personal flotation device is distributed along the front and back of the wearer for ease of wear and movement. However, the maximum buoyancy of the device which can be achieved is often reduced by the manufacturer in order to achieve a lighter weight and less bulky personal flotation device. This could be overcome by using a substance, such as a gas, which can be stored in a compressed manner and then be expanded only when necessary.

Accordingly, a need remains for a combination wet suit and flotation device for maintaining a user's head above a water line that is easy to wear, convenient, and improves a water-sport enthusiast's safety.

BRIEF SUMMARY OF THE INVENTION

In view of the foregoing background, it is therefore an object of the present invention to provide a combination wet suit and flotation device. These and other objects, features, and advantages of the invention are provided by a combination wet suit and personal flotation device for maintaining a user's head above a water line. The wet suit is adaptable for conforming to a user's body and is formed from insulating material. The wetsuit allows a thin layer of water to penetrate the wetsuit where the thin layer is by and large retained, allowing a user to maintain his or her temperature by merely warming up this thin layer of water—as opposed to the rapid loss of heat throughout all skin surfaces exposed directly to the ocean water.

Most wetsuits today are formed from flexible neoprene material for advantageously maintaining a user's body temperature at a safe level. Such a wetsuit may be made in variety of coverages, including full wetsuits with optional hoods which cover the torso, arms and legs, spring suits which cover the torso, arms, and legs down to the knees, jackets which cover from the waist to the neck with long or short sleeves, and vests which cover only the torso above the waist with "overall" loops over the shoulders. These different amounts of coverage in a wetsuit allow a user to select a wetsuit suitable for a particular location or season. Different wetsuits are also made with different stitching styles, including wetsuits with separate arm and leg portions sewn to a torso section, full length panels stitched together to form the wetsuit, and other combinations. The invention is adaptable to all wetsuits in terms of their coverage and in terms of their stitching styles.

While the invention was primarily invented as a safety feature to be built into new wetsuits, it is also usable by surfers who already own a wetsuit and would like to still obtain the safety edge this product provides. The iteration of the invention which comes as a vest can be easily worn over an existing wetsuit with the invention built into it, and the vest will add a layer of insulation in addition to allowing a surfer or other user held under water for a dangerous period of time the ability to "pull the ripcord" and inflate the vest.

All versions of the iteration may, optionally, includes an upper torso section that has front and rear portions wherein the rear portion includes a pocket that has a flap-movable between open and closed positions for maintaining a waterproof seal. Such a pocket includes a flexible retaining strap that has opposed end portions secured within the pocket and removably fastened thereto respectively. The strap advantageously secures objects thereto and assists a user to maintain the objects in a substantially stable and dry position. The wet suit further has a pair of leg and arm portions integral with the torso section and extending outwardly therefrom. It should be noted, however, that this pocket is not required for the invention to function.

The wet suit may, optionally, further include a water proof clip that has removably engageable first and second portions attached to the flap and the pocket respectively. The first portion is disengaged from the second portion when the second portion is pushed forwardly away from the flap portion so that a user can effectively access the pocket and advantageously replace a CO2 canister (described hereinbelow) during periodic intervals.

The invention also includes an inflatable bladder which can be found in a number of forms, locations and shapes. In one iteration, the bladder is integral with the front portion of the torso section and positioned generally medially thereof subjacent to the user's head. Such a bladder defines a cavity for receiving decompressed CO2 therein and thereby providing buoyancy as needed. In other iterations, the bladder can be shaped roughly in a "U" shape with inflatable panels on either side of the user's chest and a connection between the panels behind the user's head, thereby providing for a larger volume or air, and, hence, a greater amount of buoyancy to the user.

The present invention further includes a mechanism for inflating the bladder. The inflating mechanism preferably includes a CO2 canister which can be triggered by the user to inflate the bladder. In some iterations, the CO2 canister is disposed within the pocket for dispensing CO2 during operating conditions. The strap extends about a partial circumference of the canister for effectively maintaining same at a substantially stable position. The inflating mechanism further includes a valve for regulating the flow of CO2 into the bladder and a tube that has a horizontally disposed longitudinal axis and opposed end portions for defining a pathway through which CO2 is directed. One such end portion is connected to the canister and another such end portion is connected to the valve. In other iterations, the CO2 canister can be attached under a flap of the wetsuit, slipped under the wetsuit next to the user's skin or existing wetsuit should the user be wearing the vest iteration of the invention, or, indeed, can be merely hung on the side of the wetsuit. While the CO2 canister is secure in a pocket, with an adequate means of attachment between the CO2 canister and the tube by which it inflates the bladder, a pocket is not necessary and is merely optional.

The inflating mechanism also includes a flexible pull cord including a handle for initiating the flow of CO2. The pull cord has opposed end portions secured to the valve and the handle respectively. The handle assists a user to selectively pull the cord and open the valve for advantageously inflating the bladder wherein the bladder is caused to expand as CO2 flows out of the canister and into the bladder.

To fully understand the advantage this invention gives to users, it is necessary to delve a bit into the darker side of several sports in which the invention is particularly useful. Surfing was the sport which spawned this invention and will be discussed first. In surfing normal-sized waves, a surfer taking a "wipe out" is normally held under water for a few seconds before the wave passes by, allowing the surfer to swim to the surface. In big wave surfing, however, a large wave may hold a surfer down for 30 seconds or longer. This may not seem to be a huge price to pay for the thrill of riding large waves, but when we take into account that waves come in sets of waves that usually number anywhere between three and seven waves per set, and that the waves in a set are usually spaced anywhere from ten to forty seconds apart, it doesn't take a rocket scientist to figure out that a surfer held under water for 30 seconds by the first wave of a set could come to the surface just as another wave was breaking, thereby rendering the surfer up the proverbial creek without a paddle as his or her intended breath of air turned into a face-first blasting by many tons of water. Thus, the invention provides a way by which a user can rapidly come up for a breath before being pummeled by the next wave. A ready supply of extra CO2 canisters could theoretically allow a user to resupply as he/she deflates the bladder after coming up and drives under the next wave, or, should the user keep the bladder inflated, allow him/her to come up more quickly after each wave passes over.

The invention is also handy for personal watercraft rescues, as in large surf many surfers are towed into the waves by personal watercraft, which then hover nearby for rescue should the surfer wipe out in the impact zone of the surf spot. A surfer with the invention could come up more quickly and thereby allow a rescuer to get in more quickly, retrieve the surfer and motor out of the impact zone before the next wave.

SCUBA divers may also find the invention useful as a backup to their buoyancy compensation device, or BC. Normally a BC is inflated by the user's mouth from air he/she has drawn from a tank, but there have been an amazingly large number of instances where the diver has misread the air supply or made another mistake whereby the air supply runs out before surfacing. In these situations, the SCUBA diver has a greater chance of cheating Darwin by pulling on the handle of the invention and suddenly floating rapidly up to the surface than spending the last few minutes of his or her life pondering why he or she ran out of air 100 or feet down.

Kayakers, canoeists, and river rafters often ply their sport on "snow-melt" rivers, which means, as the term implies, that the snow they were skiing in winter has now melted into water . . . very cold water. It is not uncommon to hear of rivers in the high 30's and lower 40's being rafted, canoed, and kayaked. Thus, the insulative qualities of the vest iteration of the invention could prove to be a handy means of increasing a user's safety margin along with keeping him or her warm.

River rapids are formed by rocks and irregularities in the river bottom; the more rocks, the more fun for most river users. Some rapids, however, have dangerous "keeper holes", which are very strong, recirculating vortexes of water with enticingly descriptive names such as "Maytag", "Nightmare Island", "Widowmaker" and "Satan's Cesspool". Should a river user be unlucky enough to fall into the water in such a rapid, there is a chance he or she would end up being trapped underwater for an uncomfortably long period of time and would prefer to rise to the surface rapidly rather than count trout under snowmelt conditions. In such a case, the user could pull the handle and increase his or her buoyancy, thereby rising to the surface quickly. In some situations, adding buoyancy can not only get the user to the surface (where he/she can swim out of the hole, or at least breath until a rescuer throws in a rescue line), but also escape underwater ankle-pinners such as crevices between two boulders.

The present invention also includes an optional mechanism for conveniently adapting the wet suit between open and closed positions. Such an adapting mechanism, preferably including a zipper, is secured along the torso section. Of course, other conventional fasteners such as Velcro, for example, may be employed without departing from the true scope of the present invention.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
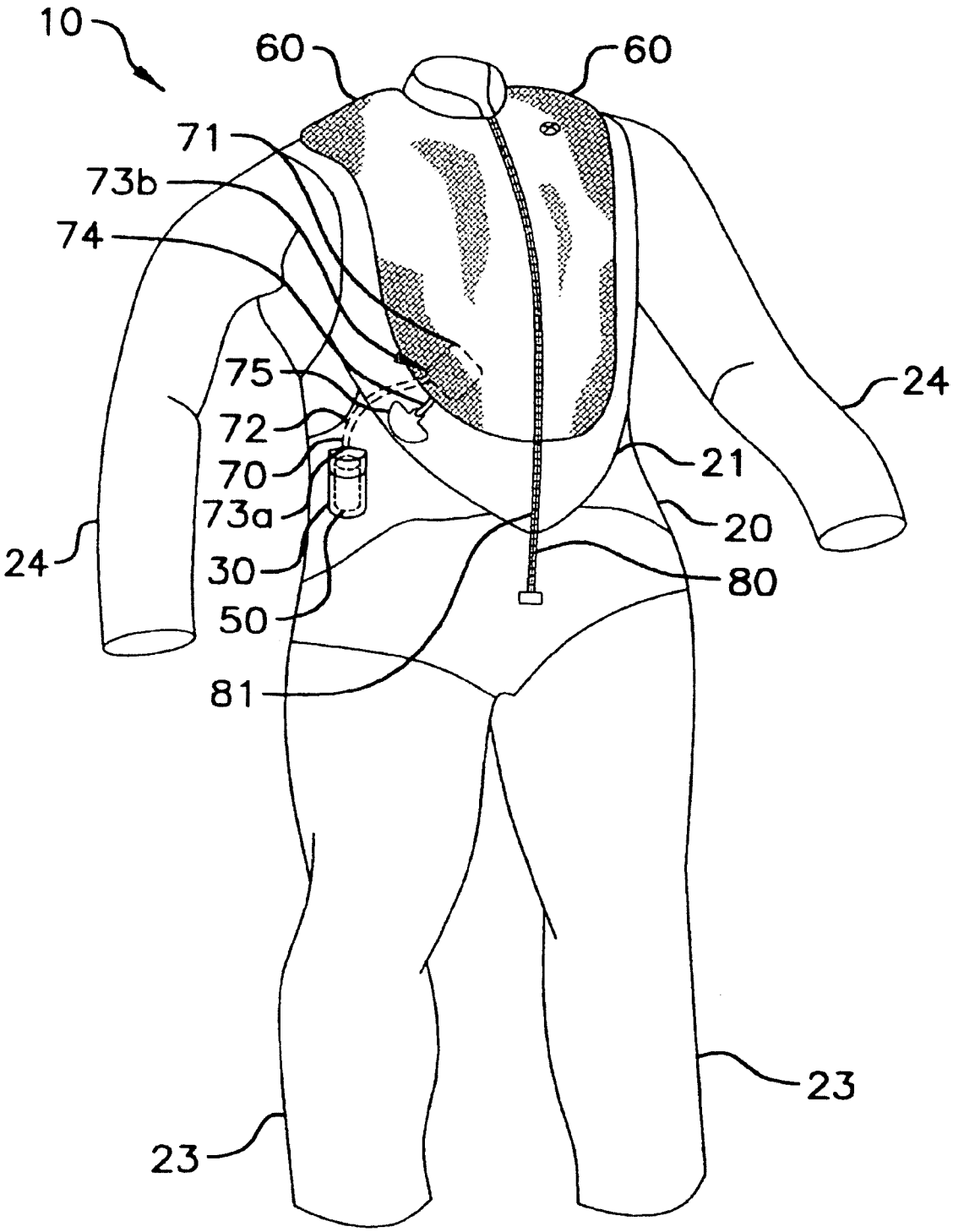
FIG. 1 is a perspective view showing a combination wet suit flotation device, in accordance with the present invention.

The present invention will now be-described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The device of this invention is referred to generally in FIGS. 1-7 by the reference numeral 10 and is intended to provide a combination wet suit and flotation device. It should be understood that the device may be used to inflate many different objects and should not be limited to only wet suits.

Referring initially to FIG. 1, one iteration of the device 10 includes an upper torso section 20 that has front 21 and rear 22 portions wherein the rear portion 22 includes a pocket 30 that has a flap movable between open and closed positions for maintaining a water-proof seal. In the iteration illustrated by this figure, the pocket 30 optionally includes a flexible retaining strap that has opposed end portions 33*a, b* secured within the pocket 30 and removably fastened thereto respectively. The strap 32 advantageously secures objects thereto and assists a user to maintain the objects in a substantially stable and dry position. The wet suit 10 further has a pair of leg 23 and arm 24 portions integral with the torso section 20 and extending outwardly therefrom. It should be noted that this method of stitching various "body parts" together into a wetsuit is merely one of the many patterns of wetsuits today and is not intended to be limiting in any way on the wetsuits upon which the invention can be practiced. Indeed, it is well known that some wetsuits have entire torso/legs front and back panels that are stitched together on the side, with arms then stitched onto the arm openings, and that other wetsuits have torso and arm front and back panels to which the leg panels are stitched.

The wet suit 10 may further optionally include a water proof clip 40, which has removably engageable first 41 and second 42 portions attached to the flap 31 and the pocket 30 respectively. The first portion 41 is disengaged from the second portion 42 when the second portion 42 is pushed forwardly away from the flap portion 31 so that a user can effectively access the pocket 30 and advantageously replace a CO2 canister 50 (described hereinbelow) during periodic intervals. The water proof clip 40 prevents water from entering the canister 50, which under normal circumstances would damage the canister 50, respectively.

The device also includes an inflatable bladder 60. In the iteration of the invention illustrated by FIG. 1, the bladder is integral with the front portion 21 of the torso section 20 and positioned generally medially-thereof subjacent to the user's head. The positioning of the bladder 60 ensures that it will keep an individual afloat when inflated, but also advantageously does not restrict the movement of the wetsuit wearer when it is deflated. Such a bladder 60 defines a cavity 61 for receiving decompressed CO2 therein and thereby providing buoyancy as needed. As will be apparent from FIGS. 8 and 9, such a location for the bladder is not a necessary or limiting factor, as there are a variety of locations for the bladder.

Figure 7:
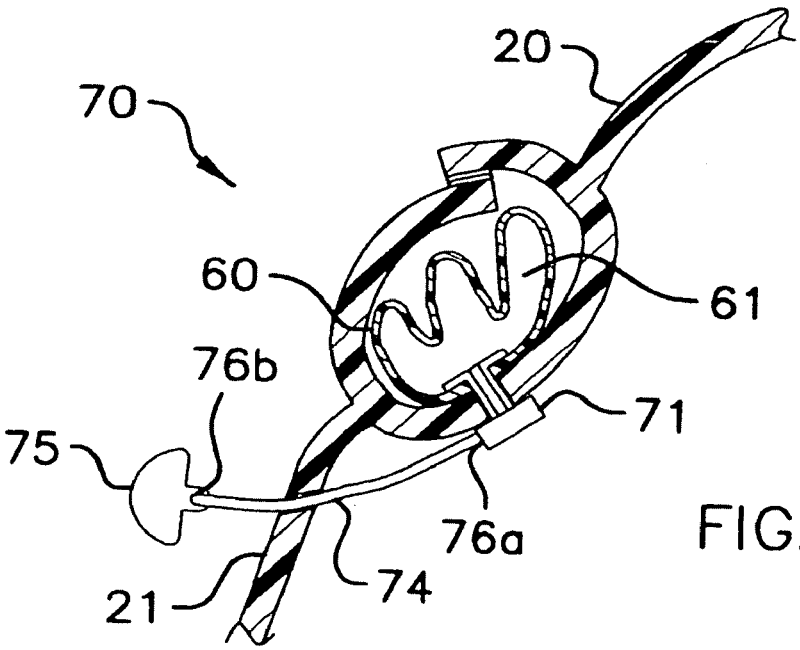
FIG. 7 is a cross-sectional view of the bladder showing the pull-cord and valve attached thereto.

The present invention further includes a mechanism 70 for inflating the bladder 60. The inflating mechanism 70 includes a CO2 canister 50 which can be disposed in a variety of locations, for example, in the iteration illustrated in FIG. 1, within the pocket 30 for dispensing CO2 during operating conditions. The strap 32 in this iteration extends about a partial circumference of the canister 50 for effectively maintaining same at a substantially stable position. As is shown in FIG. 7, the inflating mechanism 70 further includes a valve 71 for regulating the flow of CO2 into the bladder 60 and a tube 72 that has a horizontally disposed longitudinal axis and opposed end portions 73 for defining a pathway through which CO2 is directed. One such end portion 73*a* is connected to the canister 50 and another such end portion 73*b* is connected to the valve 71. FIG. 7 merely identifies one such possible arrangement of these components; others are possible and FIG. 7 is not intended to be limiting.

Figure 2:
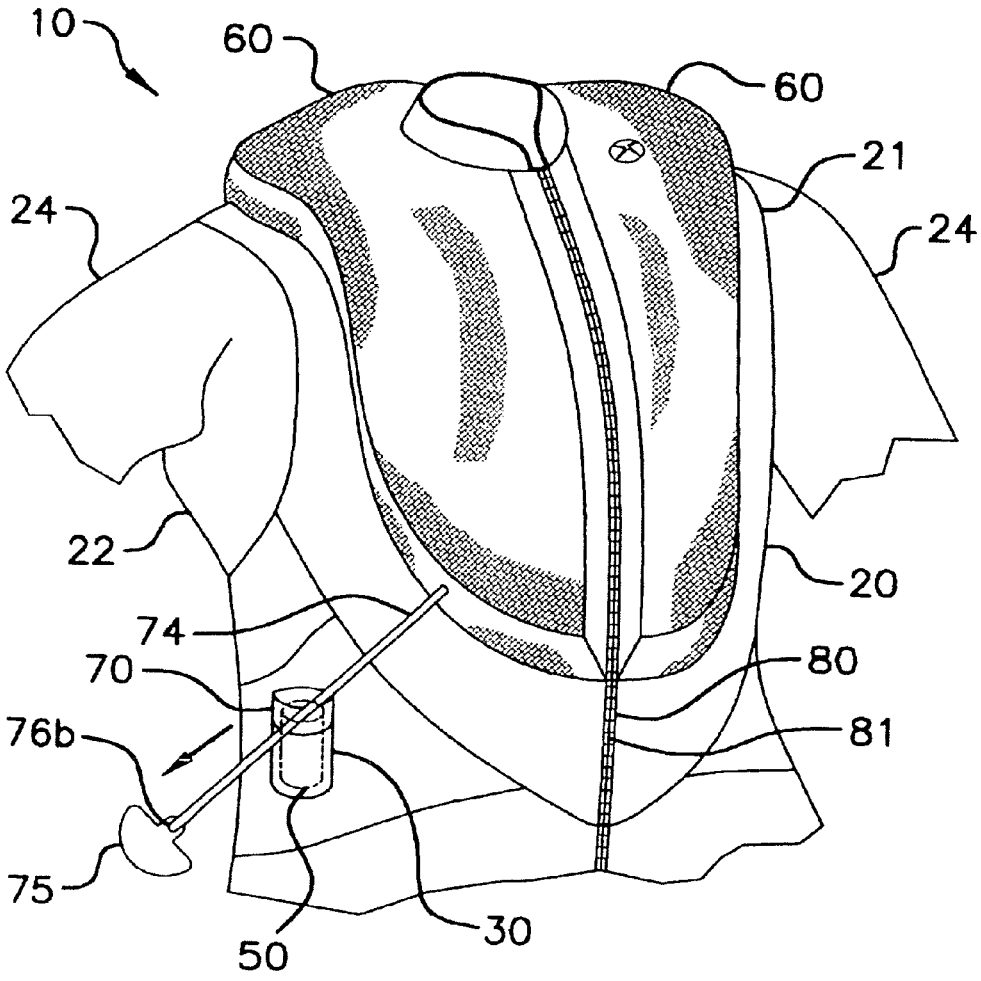
FIG. 2 is an enlarged perspective view showing the CO2 canister and pull cord connected thereto.
Figure 3:
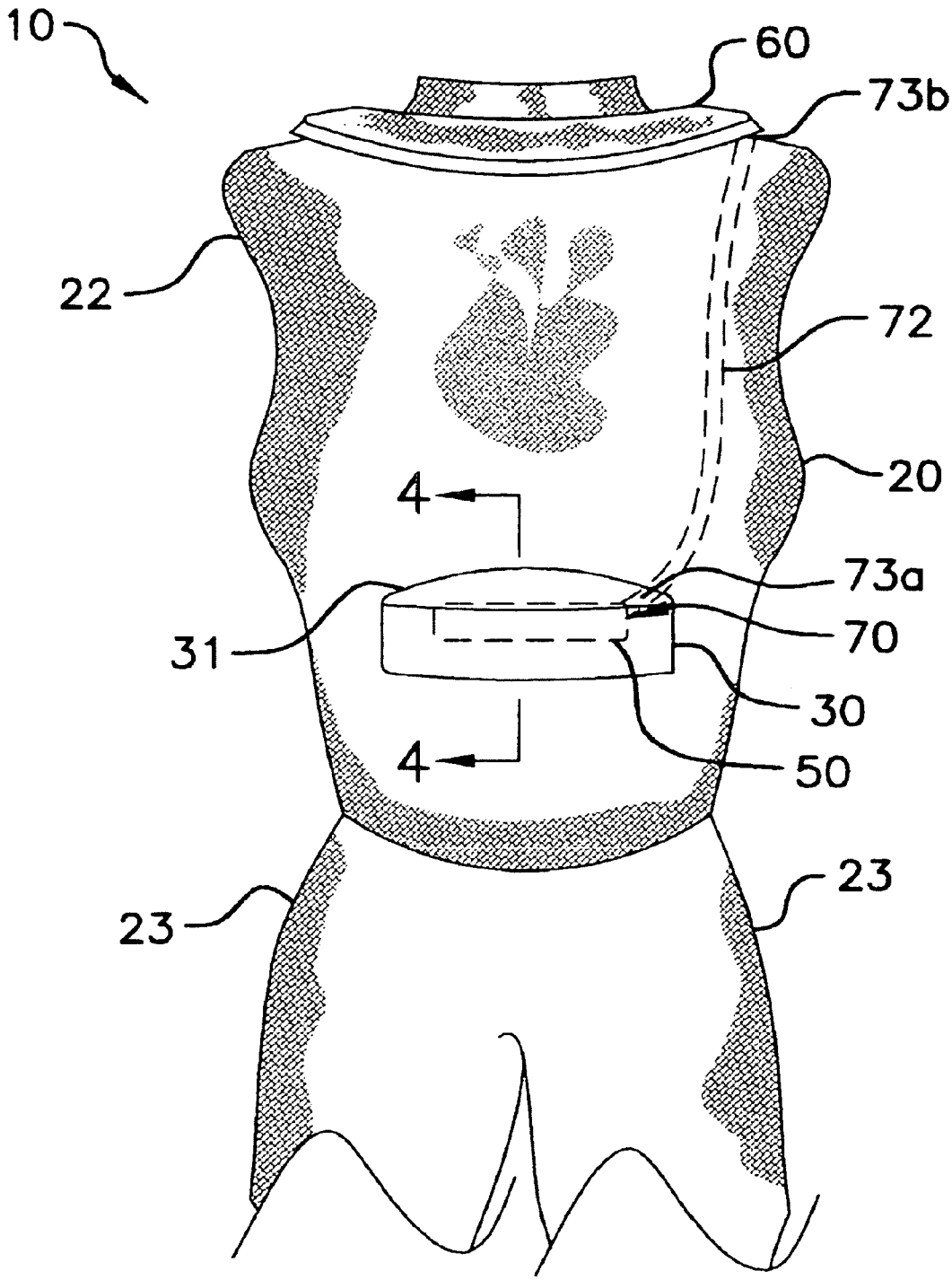
FIG. 3 is a rear elevational view of the pocket housing the canister at a horizontal position.
Figure 4:
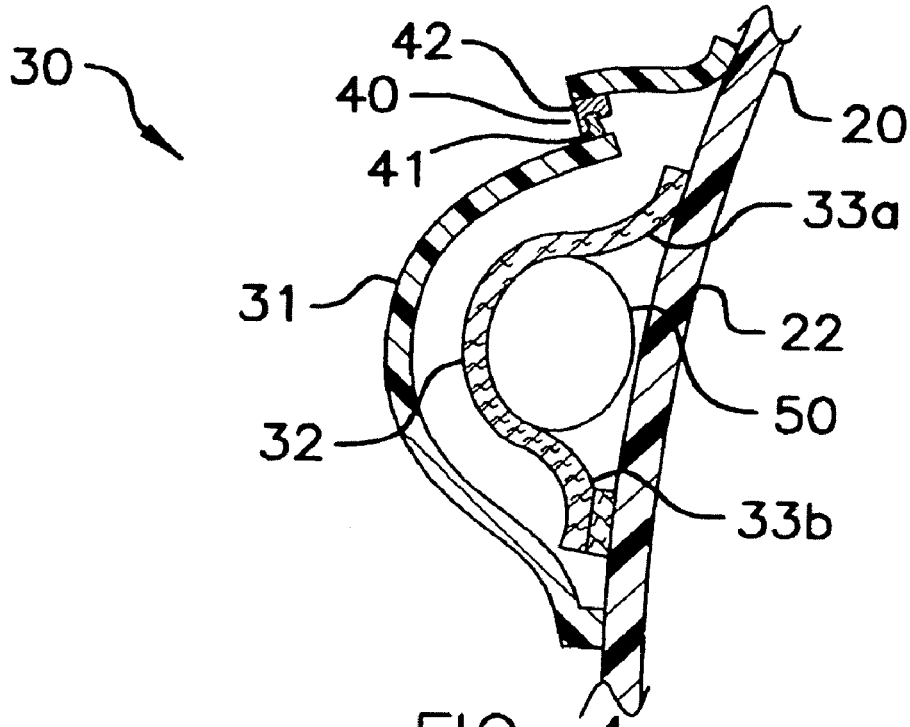
FIG. 4 is an enlarged cross-sectional view of the pocket and adjustable strap, taken along line 4-4 in FIG. 3.
Figure 5:
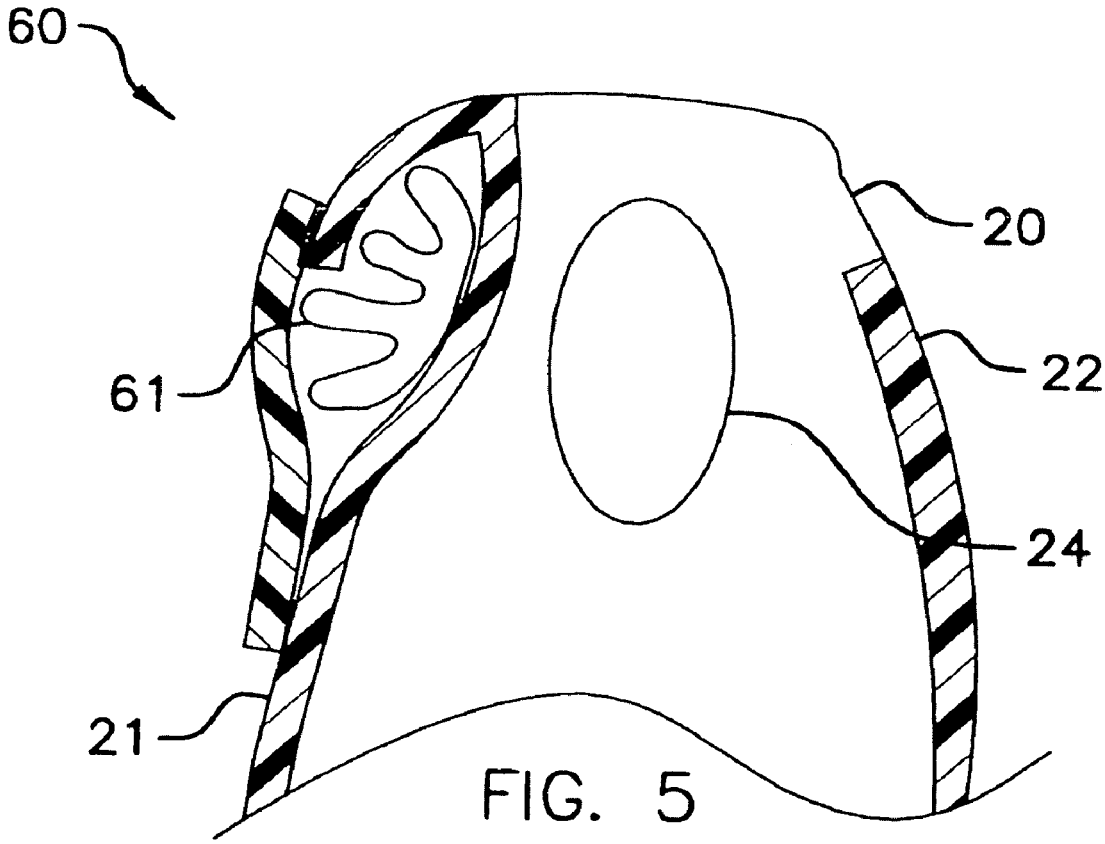
FIG. 5 is an enlarged cross-sectional view showing the bladder at a deflated position.
Figure 6:
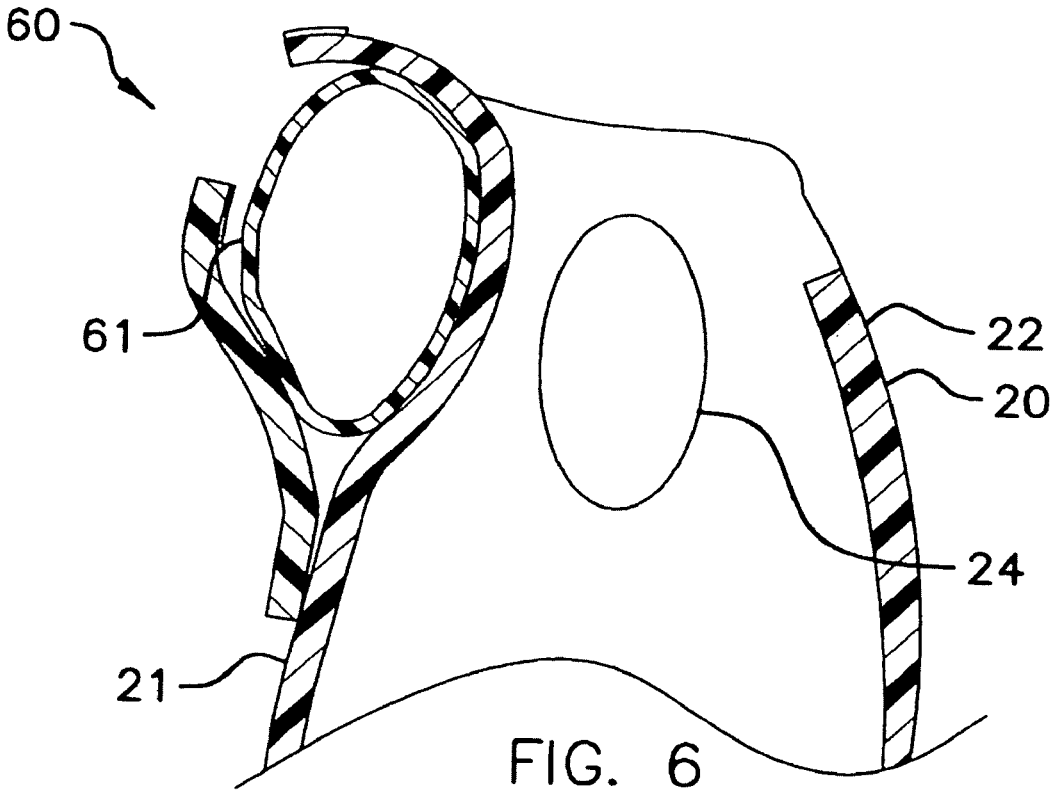
FIG. 6 is a cross-sectional view showing the bladder at an inflated position.

The inflating mechanism 70 also includes an optionally flexible pull cord 74, as illustrated in FIGS. 1, 2 and 7, including a handle 75 for initiating the flow of CO2. The pull cord 74 as illustrated in FIG. 1 has opposed end portions 76*a, b* secured to the valve 71 and the handle 75 respectively. This is an optional shape for the pull cord and is not intended to be limiting. The handle 75 assists a user to selectively pull the cord 74 and open the valve 71 for advantageously inflating the bladder 60 wherein the bladder 60 is caused to expand, as shown in FIG. 6, as CO2 flows out of the canister 50 and into the bladder 60. Thus, when a surfer or other individual wearing a wetsuit, finds himself or herself in a situation where floating by their own means is no longer possible, a simple pull on the handle 75 can add buoyancy and assist in allowing the user to float rapidly to the surface.

The present invention also includes an optional mechanism 80 for conveniently adapting the wet suit 10 between open and closed positions. Such an adapting mechanism 80, including a zipper 81, is secured along the torso section 20. Of course, other conventional fasteners such as Velcro, for example, may be employed without departing from the true scope of the present invention. While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention. In particular, with respect to the above description, it is to be realized that the optimum dimensional relationships for the parts of the present invention may include variations in size, materials, shape, form, function and manner of operation.

Figure 8:
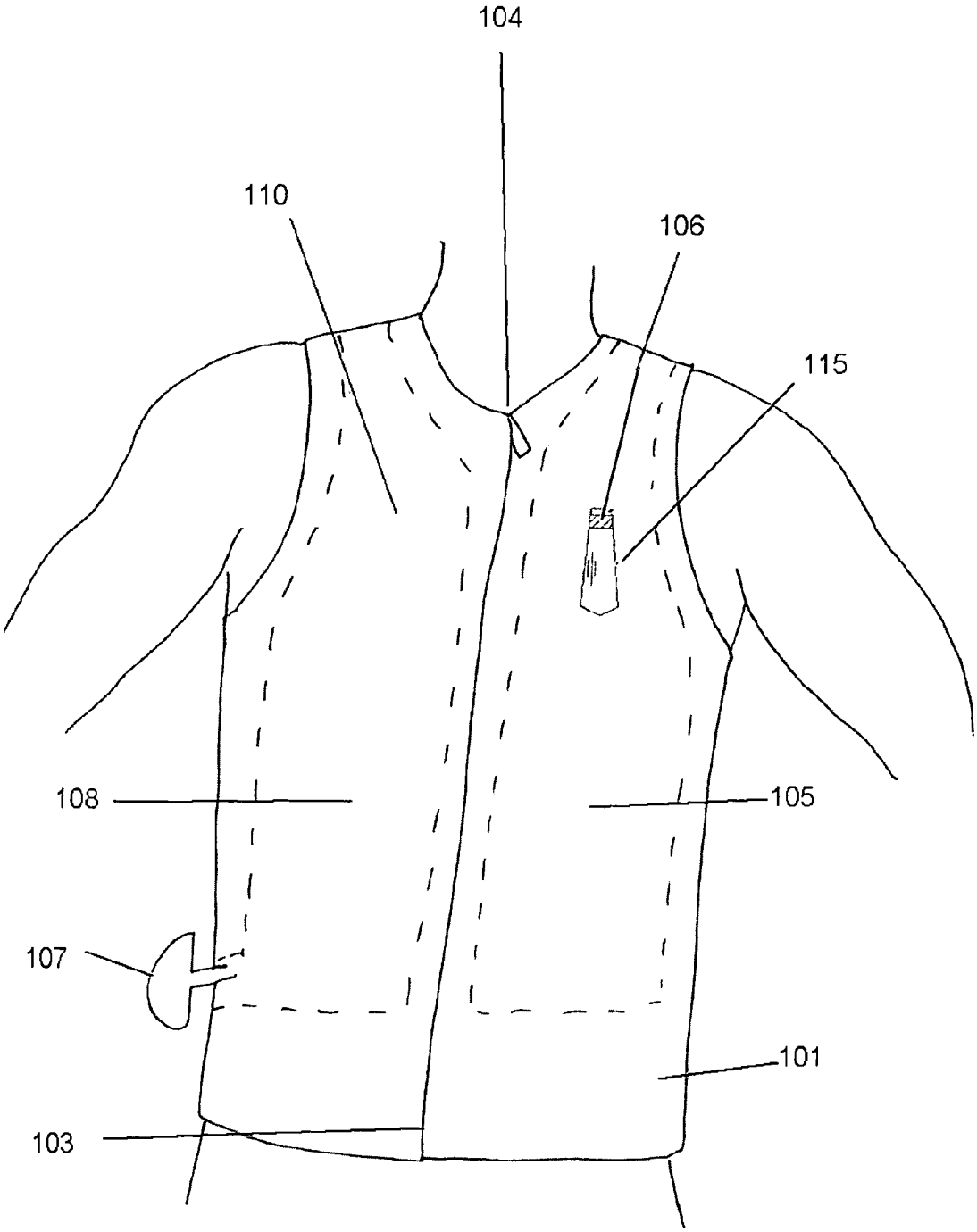
FIG. 8 is a front view of the vest iteration of the invention showing the various parts; and, FIG. 9 is front view of the bladder of the vest iteration, showing how it appears before being inserted into the vest.

FIG. 8 illustrates the vest version of the invention. The vest can be worn by surfers in warm waters, such as Hawaii, over a user's skin, or over another wetsuit in colder waters, such as Northern California. The vest is also useful for kayakers, canoeists, spelunkers, river rafters, and other non-surfers who practice their sport in cold climates or in cold rivers or caves. These users of the invention can easily put it over drysuits, spelunking gear, and regular clothing to give themselves the option of adding immediate buoyancy and providing some insulation at the same time. No matter how it is used, the vest provides another means by which a user can instantly gain substantial buoyancy. The vest is formed with an inner (not shown in this figure) and outer surface layer (101), where the two layers are connected at the edges of the vest such that they form a hollow portion, into which a bladder (105) fits. The two layers can exist on all portions of the vest, in which case a line of stitching can hold the bladder in place, as is shown in FIG. 8, or there can be an internal layer which covers the entire chest region of the user with an external layer only over the portions of the body covered by the bladder. The vest has an opening for the neck of the user and shoulder straps (102) that allow for a large enough neck opening such that the user can use the vest either with an existing wetsuit underneath the vest or as a stand-alone vest. In this figure, the front of the vest is formed from two sections of wetsuit material, usually neoprene, which zip together in the front (103) with a zipper (104) providing the means of putting on or taking off the vest. The vest can also be made in a pull-over fashion, where there is no zipper. The bladder in the vest is a one-piece bladder which has two front panels (108) connected by a loop of the bladder which runs behind the user's head.

To inflate the bladder, the user pulls on a handle (107) to a pull cord (not shown in this figure), which is attached to a removable CO2 canister (not shown in this figure) which inflates the bladder upon being activated. If the inflated vest begins to lose buoyancy, or if the user wishes to partially or totally deflate the vest, he/she can do so by blowing into or bleeding air from the inflation adjustment valve (115), which is located conveniently to the user's mouth and hands.

Figure 9:
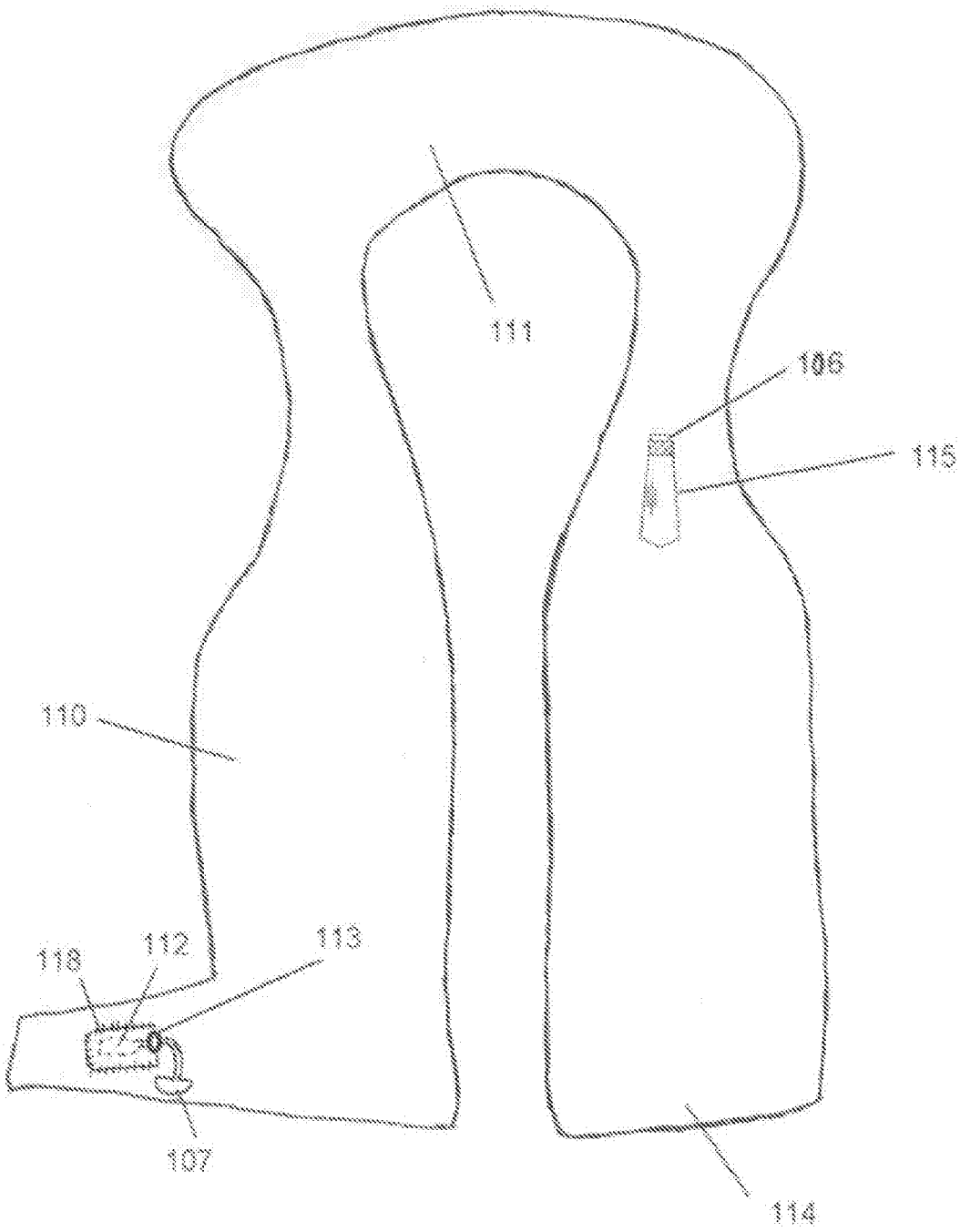

FIG. 9 is a front view of the bladder of the vest shown in FIG. 8. The bladder has two chest panels (110) and a neck loop (111) which connects the two chest panels. There is an inflation adjustment valve (115) with a nozzle (106) by which the user can orally add air or manually bleed air from the bladder. To add air to the bladder, the user merely blows into the inflation adjustment valve. The inflation adjustment valve can have a one-way valve which allows air to be blown in but doesn't allow air to seep out. To deflate the bladder, there can be a number of devices employed which are already on the market. One such device is a screw valve, which has a screw that can be tightened to form a seal, thereby preventing air from escaping, or loosened to allow air to be blown in or to allow air to escape. Another potential device is a purge valve, A purge valve is a small round diaphragm, usually made from silicone, which has a spring which causes its "resting position" to be a closed position, but can be manually opened partially or all of the way by depressing the purge button with a finger or thumb. When installed at the interface between an air containing canister and a water environment, the purge valve function as a one-way membrane that will allow water to flow in one direction through the valve but not in the other direction. For example, when used in a snorkeling mask, the purge valve prevents water from entering the mask, but allows the user to exhale through his/her nose and blow water out of the valve, thereby forcing any water that has collected in the mask out through the purge valve into the surrounding water.

To inflate the bladder the user merely pulls on the handle (not shown in this figure) which causes the removable CO2 canister (112) to send air through a valve or plug receptacle (113) in the bladder. The plug serves two main purposes: first, to removably retain the CO2 canister in attachment with the bladder so that the CO2 canister is ready to inflate the bladder when necessary and so that a user can remove an expired CO2 canister when desired; second, to serve as a conduit between the CO2 canister and the bladder such that when a user pulls the handle, the contents of the CO2 canister rush into the bladder, filling it and adding immediate and substantial buoyancy to the user of the invention.

It should be noted that having chest panels (110) adds buoyancy to the invention above and beyond that possible when the bladder occupies a smaller area higher on the chest, as is the case on other iterations of the invention. By having a substantial portion of the bladder near the user's waist (114), the user's head is buoyed up well above the water level.

The assembly and use of the present invention are deemed readily apparent and obvious to one skilled in the art.

I claim:

1. A combination wetsuit and flotation device comprising:

a wetsuit including a torso portion having a front portion and a rear portion, a pocket located within the torso portion adjacent to the rear portion, a retaining strap located within the pocket for securing a compressed gas canister within the pocket, the pocket having a flap movable between an open position and a closed position, and a waterproof clip for preventing water from entering the pocket, the waterproof clip comprising a first portion and a second portion removably engaged with the first portion, wherein the first portion is attached to the flap and the second portion is attached to the pocket, wherein when the first portion is engaged with the second portion water is prevented from entering the pocket, the retaining strap having opposed ends secured to the wetsuit;

an inflatable bladder integral with the front portion, the inflatable bladder in fluid connection with the compressed gas canister such that compressed gas may flow into the inflatable bladder;

a pull cord for inflating the inflatable bladder, the pull cord coupled on one end to a valve and on the other end to a handle located exterior to the wetsuit, the valve coupled to the compressed gas canister and the inflatable bladder, wherein when a user pulls the handle, the valve opens to allow compressed gas to flow from the compressed gas canister into the inflatable bladder; and an inflation adjustment valve coupled to the inflatable bladder to allow a user to manually blow air into the inflatable bladder, the inflation adjustment valve comprising a one-way valve for allowing air into the inflatable bladder.

2. The combination wetsuit and floatation device of claim 1, wherein the wetsuit includes arm portions and leg portions coupled to the torso portion.

3. The combination wetsuit and floatation device of claim 1, wherein the wetsuit is configured as a vest.

4. The combination wetsuit and floatation device of claim 1, wherein the inflatable bladder includes two chest panels, a neck loop, where the inflation adjustment valve is coupled to one of the chest panels in proximity to the neck loop to allow a user to manually blow air into the inflatable bladder.

5. The combination wetsuit and floatation device of claim 1, wherein the wetsuit further includes an inner section and an outer section, the inner section resting against a user, the outer section coupled to the inner section at one or more locations along the edge of the outer section, wherein the inflatable bladder is retained between the inner section and the outer section.

6. The combination wetsuit and floatation device of claim 1 further comprising a handle coupled to the distal end of the pull cord, the handle located exterior to the wetsuit.

7. A combination wetsuit and flotation device comprising:

a wetsuit having a pocket located therein and retaining strap located within the pocket for securing a compressed gas canister within the pocket, the pocket having a flap movable between an open position and a closed position, wherein when the flap is in the closed position water is prevented from entering the pocket, the retaining strap having opposed ends secured to the wetsuit;

an inflatable bladder in fluid connection with the compressed gas canister such that compressed gas may flow into the inflatable bladder;

a pull cord for inflating the inflatable bladder, the pull cord coupled to a valve, the valve coupled to the compressed gas canister and the inflatable bladder, wherein when a user pulls the pull cord the valve opens to allow compressed gas to flow from the compressed gas canister into the inflatable bladder;

means for deflating the inflatable bladder coupled to the inflatable bladder; and an inflation adjustment valve coupled to the inflatable bladder to allow a user to manually blow air into the inflatable bladder, the inflation adjustment valve comprising a one-way valve for allowing air into the inflatable bladder;

wherein the means for deflating the inflatable bladder is a screw valve or a purge valve.

8. The combination wetsuit and floatation device of claim 7, wherein the wetsuit includes a torso portion having a front portion and a rear portion, wherein the pocket is located adjacent to the rear portion and the inflatable bladder is integral with the front portion.

9. A combination wetsuit and flotation device consisting of:

a wetsuit including a torso portion having a front portion and a rear portion, and a retaining strap for securing a compressed gas canister to the wetsuit, where the retaining strap having opposed ends secured to the wetsuit;

an inflatable bladder integral with the front portion, the inflatable bladder in fluid connection with the compressed gas canister such that compressed gas may flow into the inflatable bladder;

a pull cord for inflating the inflatable bladder, the pull cord coupled on one end to a valve and on the other end to a handle located exterior to the wetsuit, the valve coupled to the compressed gas canister and the inflatable bladder, wherein when a user pulls the handle, the valve opens to allow compressed gas to flow from the compressed gas canister into the inflatable bladder;

an inflation adjustment valve coupled to the inflatable bladder to allow a user to manually blow air into the inflatable bladder, the inflation adjustment valve comprising a one-way valve for allowing air into the inflatable bladder; and a means for deflating the inflatable bladder coupled to the inflatable bladder;

wherein the inflatable bladder includes two chest panels and a neck loop, where the inflation adjustment valve is coupled to one of the chest panels in proximity to the neck loop to allow a user to manually blow air into the inflatable bladder.

* * * * *